US005655376A

United States Patent [19]

Price

[11] Patent Number: 5,655,376

[45] Date of Patent: Aug. 12, 1997

[54] COMBINATION COOLANT PUMP/DYNAMIC BALANCER FOR STIRLING REFRIGERATORS

[75] Inventor: Kenneth D. Price, Long Beach, Calif.

[73] Assignee: Hughes Electronics, Los Angeles, Calif.

[21] Appl. No.: 590,081

[22] Filed: Jan. 22, 1996

[51] Int. Cl.[6] ..... F25B 9/00; F25D 17/02

[52] U.S. Cl. ..... 62/6; 62/98

[58] Field of Search ..... 62/6, 79, 98, 99; 60/520

[56] References Cited

U.S. PATENT DOCUMENTS 5,477,687 12/1995 Horn ..... 62/6

5,477,688 12/1995 Ban et al. ..... 62/6

*Primary Examiner*—Christopher Kilner

*Attorney, Agent, or Firm*—Gordon R. Lindeen, III; Michael W. Sales; Wanda K. Denson-Low

[57] ABSTRACT

A self-cooling Stirling cycle cooler (1). The cooler (1) includes a conduit (20) for transporting thermal energy from a first location to a second location. The conduit is a closed loop having first and second ends terminating in a first chamber (29). A pump (14) is mounted in the first chamber (29) for moving the heat energy therein from the first location to the second location. The pump (14) includes a piston (40) which reciprocates in the first chamber (29). A first valve (42) is provided for controlling the direction of a flow of fluid in the conduit (20) into the first chamber (29) and a second valve (46) for controlling the flow of the fluid in the conduit (20) out of the first chamber (29). In a Stirling cycle cooler, the balancer mass is used as the pump piston to facilitate the movement of fluid in the conduit. By utilizing the balancer mass of a Stirling cycle cooler, self-cooling is effected with minimal additional hardware, weight and cost.

13 Claims, 3 Drawing Sheets

COMBINATION COOLANT PUMP/DYNAMIC BALANCER FOR STIRLING REFRIGERATORS

BACKGROUND OF THE INVENTION

1. Field of the Invention

The present invention relates to systems and apparatus for dissipating heat. More specifically, the present invention relates Stifling cycle type cooling systems and similar apparatus.

2. Description of the Related Art

In many applications, dissipation of heat is a significant concern for systems designers. Cooling systems such as Stirling Cycle coolers, have been developed and used successfully to maintain operating temperatures of circuits, devices and components within specified ranges. Unfortunately, the cooler itself represents a point source of heat. On a spacecraft, this point source may be embedded deep within the spacecraft. Hence, heat dissipation is particularly problematic in spacecraft applications as ambient air is typically not available as a heat sink. As a result, the thermal energy must be moved to a radiating panel on the spacecraft. There are at least two conventional approaches to this problem.

First, a conductor may be used to transport thermal energy. However, this approach may require 30–50 additional pounds of dead weight in conductive material such as copper. Notwithstanding the cost of the conductor and the labor associated with its installation, the launch cost alone (approximately $50,000 per pound) is such that this option is not attractive for most applications.

A second conventional approach involves the use of heat pipes. A heat pipe is a self-contained, typically rigid structure in which a working fluid is heated to a vapor by an external heat source. The vapor carries the thermal energy to a distal cold end of the pipe where it condenses back into liquid form. The liquid returns to the warm end and the process repeats until the warm end and the cold end are at a point of equilibrium. Unfortunately, the rigid heat pipes are difficult to integrate into a spacecraft structure and still impose some weight penalty.

Hence, a need remains in the art for a lightweight, low cost system or technique for dissipating heat in spacecraft and other applications.

SUMMARY OF THE INVENTION

The need in the art is addressed by the present invention, which transports thermal energy from a first location to a second location within a closed loop. Both ends of the loop terminates in a chamber in which a motivating force is provided. In the illustrative embodiment, the invention is implemented as a self-cooling Stirling cycle cooler. The cooler includes a conduit for transporting thermal energy from a first location to a second location. The conduit is a closed loop having first and second ends terminating in a first chamber. A pump is mounted in the first chamber for moving the heat energy therein from the first location to the second location. The pump includes a piston which reciprocates in the first chamber. A first valve is provided for controlling the direction of a flow of fluid in the conduit into the first chamber and a second valve for controlling the flow of the fluid in the conduit out of the first chamber.

In a specific implementation, the refrigerating chamber of the cooler is separated into two chambers. An expander module is mounted in one chamber and a balancer mass is mounted in the other. In accordance with the teachings of the present invention, the balancer mass is used as the pump piston to facilitate the movement of fluid in the conduit.

By utilizing the balancer mass of a Stirling cycle cooler, self-cooling is effected with minimal additional hardware, weight and cost.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
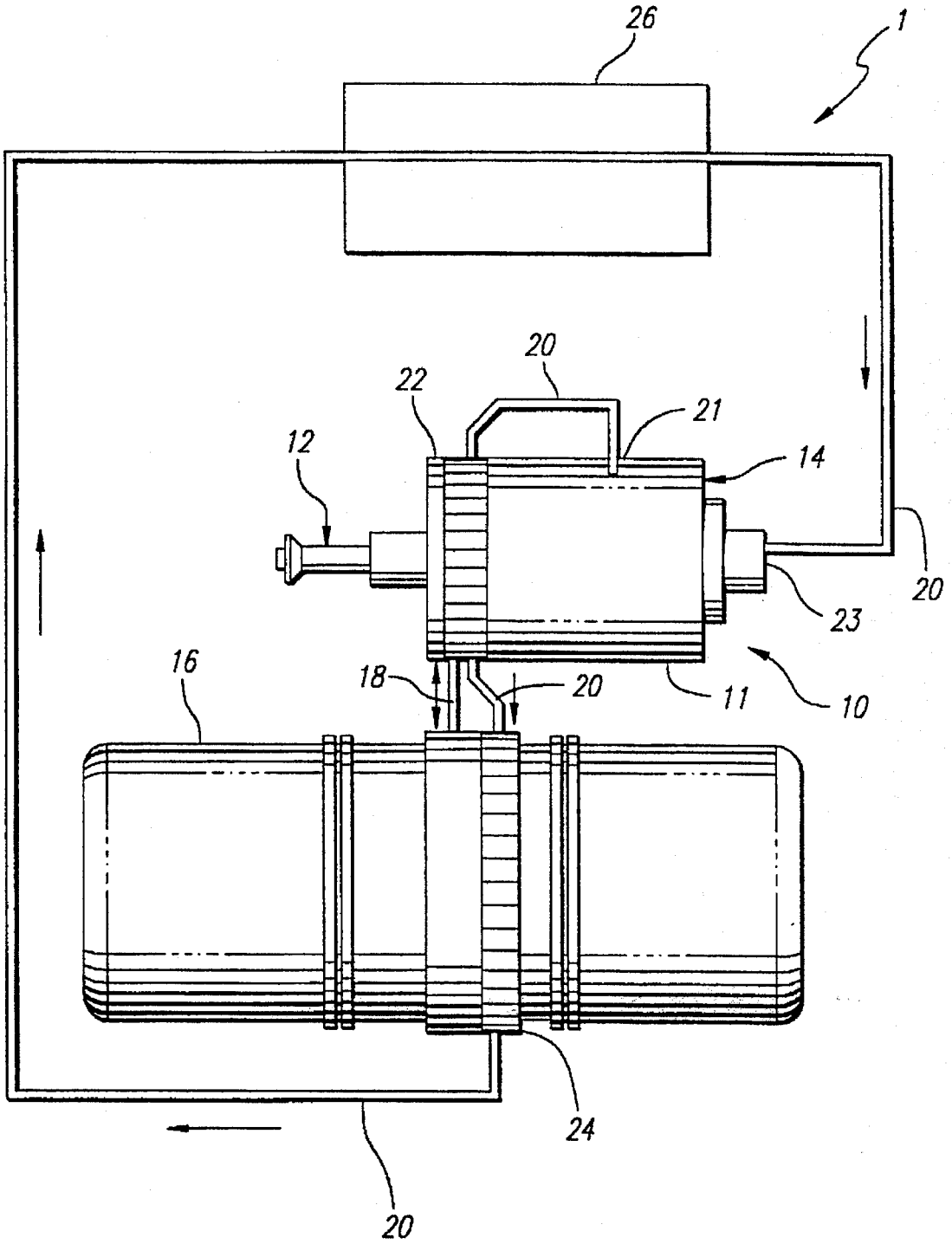
FIG. 1 is a system schematic diagram of a heat rejection system integrated with a self-cooled Stirling refrigerator designed in accordance with the teachings of the present invention.

FIG. 1 is a system schematic diagram of a heat rejection system integrated with a self-cooled Stirling refrigerator designed in accordance with the teachings of the present invention. As shown in FIG. 1, the system 1 includes the self-cooled Stirling cycle refrigerator 10 of the present invention incorporated within a housing 11. The refrigerator 10 has an expander module 12, which provides a cold tip, and a balancer pump module 14. A conventional compressor 16 compresses a working fluid which is provided to the expander module 12 of the refrigerator 10 via a transfer line 18.

In accordance with the present teachings and as discussed more fully below, the balancer pump module 14 is designed move a second working fluid, such as air or other coolant, through a second line 20 in a closed loop. High pressure fluid exits the pump 14 at an outlet 21 and passes through the line 20 through a conventional heat exchanger 22 for the expander module 12. Thermal energy is transferred from the expander module 12 into the cooling fluid as it moves through the heat exchanger 22 back to the line 20 and into a second heat exchanger 24 for the compressor 16. The second heat exchanger 24 may also be of conventional construction. Thermal energy from the compressor 16 is transferred to the cooling fluid in the line 20 as it is forced to a radiator 26 of conventional construction. As the radiator 26 transfers thermal energy into the atmosphere, the fluid in the line 20 is cooled. The cooled fluid is returned to the pump 14 at a low pressure inlet 23.

A key feature of the invention is the use of the balancer mass of a Stirling cycle refrigerator to provide the motivating force to move a cooling fluid over the expander module 12, the compressor 16 and any other "hot spots" for which cooling is desired. This provides a cooling operation with minimal additional weight or cost.

Figure 2:
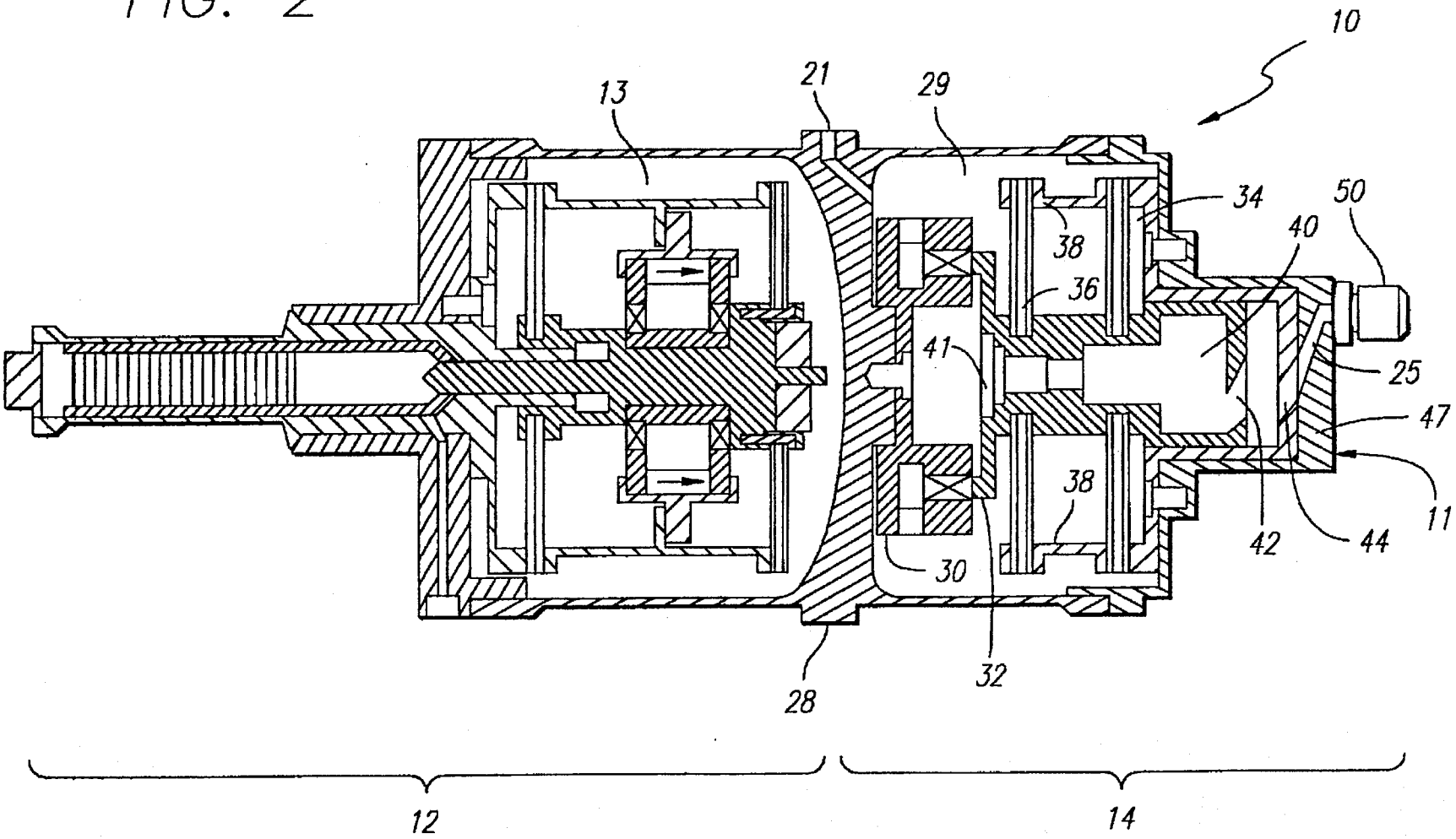
FIG. 2 is a sectional side view of an illustrative implementation of the self-cooled Stirling cycle refrigerator in accordance with the teachings of the present invention.

FIG. 2 is a sectional side view of an illustrative implementation of the self-cooled Stirling cycle refrigerator 10 in accordance with the teachings of the present invention. With the exceptions set forth below, the Stirling cycle refrigerator 10 may be constructed in a conventional manner. As is known in the art, the expander module 12 provides the cooling function and generates vibration modes in the process. Customarily, the balancer mass 14 serves the purpose of counteracting the vibration modes created by the expander module. However, in accordance with the present teachings, the reciprocating movement of the balancer mass is used to provide the motivating force which causes the second coolant to move through the line 20 as set forth above.

As depicted in FIG. 2, a first novel aspect of the present invention is the provision of a bulkhead 28 which separates the chamber 13 of the expander module 12 from the high pressure gas plenum chamber 29 of the balancer module 14. The pump assembly is best illustrated with respect to FIG. 3.

Figure 3:
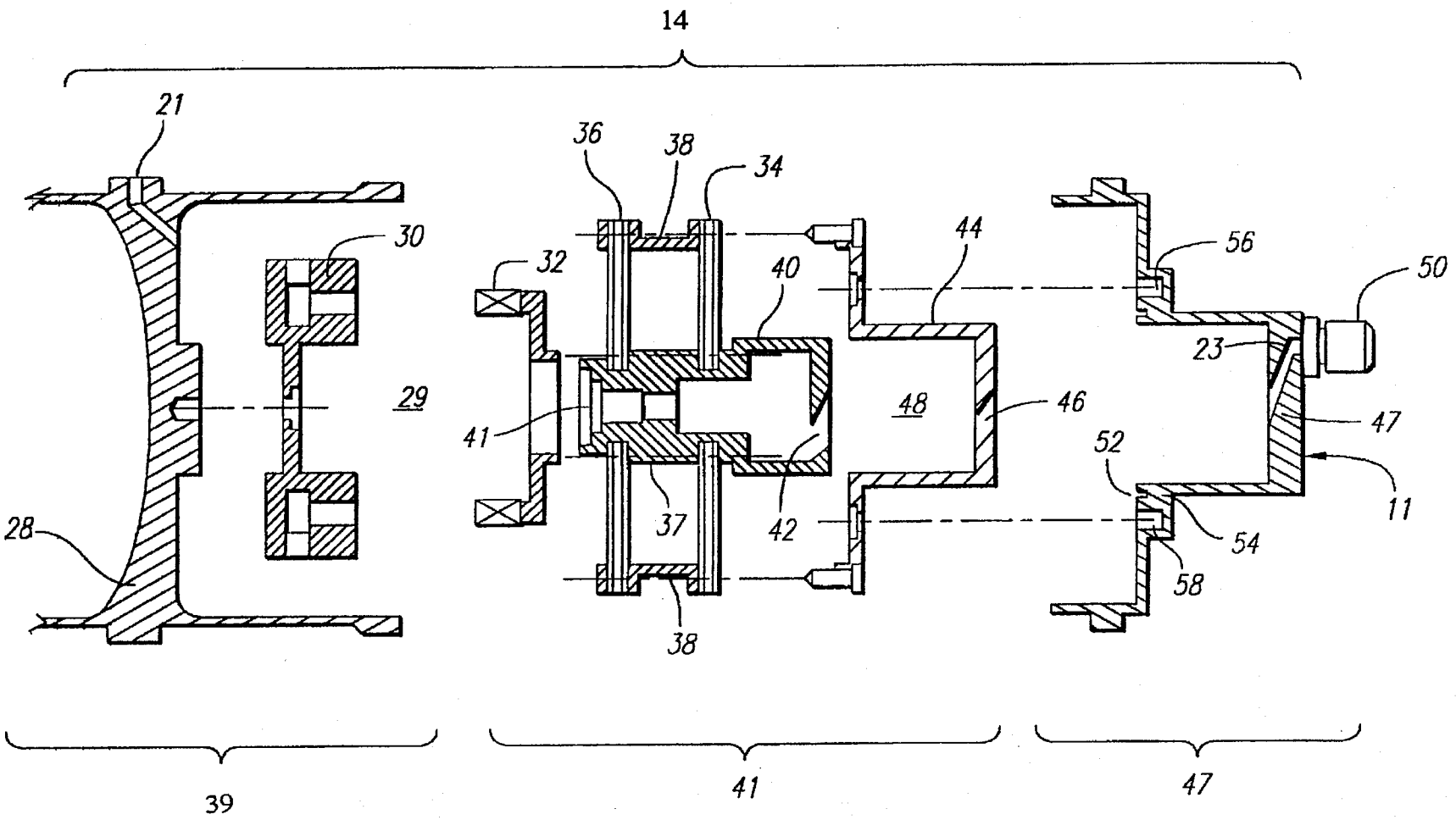
FIG. 3 is an exploded sectional side view of the pump assembly 14 of the present invention.

FIG. 3 is an exploded sectional side view of the pump assembly 14 of the present invention. The gas outlet 21 is provided through a center rib in the bulkhead 28 into the gas plenum 29. The bulkhead 28 is implemented as an extension 29 of the housing 11 of the expander module 12 and may be constructed of aluminum or other suitable material. The line 20 is connected to the gas outlet 21. A conventional motor back iron is provided by a permanent magnet ring 30. FIG. 3 shows the piston subassembly 41. The piston subassembly 41 includes a motor coil 32. The motor coil 32 may be a conventional speaker coil. The motor coil 32 is adapted for use with the permanent magnet ring 30. Front and rear flexure sets 34 and 36 respectfully, are provided and separated by inner and outer spacers 37 and 38 respectfully. The front and rear flexure sets are known in the art. These elements are typically implemented in "Oxford Coolers". The flexures serve to suspend the piston 40 as it reciprocates back and forth to extend the life of the cooler.

A first valve 42 is implemented in the head of the piston 40. The valve 42 serves as an outlet valve and, in the illustrative embodiment, is implemented as a conventional flapper type Reed valve. The piston 40 is hollow and seats in a cylinder flexure flange 44 which serves as a liner within the housing 11. An inlet valve 46 is implemented as a flapper type Reed valve within the flange 44. The novel implementation of the inlet and outlet valves as flapper valves in the piston head and in the cylinder flange 44 allows for a high compression ratio and enhanced operation relative to the alternative of using valves in the line 20 as the location of the valves as shown allows the valves to be closely located thereby limiting the dead space therebetween and affording a higher compression ratio. The valves control the direction of fluid flow in the conduit 20. For example, as the hollow piston 40 moves to the right, pressure is created in a compression space between the piston 40 and the flange 44 opening the outlet valve 42. Thus, gas enters the piston and exits through a vent 41 into the plenum 29. As the piston 40 moves in the opposite direction, the outlet valve 42 closes and the inlet valve 46 opens. The inlet 23 is provided in the end cover 47 of the housing 11. The end cover 47 is deformed to provide space for the piston 40 to reciprocate. The inlet valve 46 communicates via the inlet 23 with the gas line 20 (not shown) which is connected to a conventional fixture 50. An O-ring seal 52 seats within an annular recession 54 in the end cover housing 11. An annular bearing 56 seats within a second annular recession 58.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A cooling system comprising:

first means for transporting thermal energy from a first location to a second location, the first means being a closed loop conduit having first and second ends terminating in a first chamber;

second means mounted in the chamber for moving thermal energy within the first means from the first location to the second location, said second means being a pump, said pump including a piston which reciprocates in the first chamber;

first valve means for controlling the direction of a flow of fluid in the conduit into the chamber;

second valve means for controlling the flow of the fluid in the conduit out of the chamber, wherein at least one of the valves means includes a valve mounted in the piston;

a heat exchanger in thermal communication with a working fluid disposed in the first means for facilitating the transfer of thermal energy into the first means.

2. The invention of claim 1 wherein the second valve means is mounted in a housing for the pump.

3. The invention of claim 1 further including a radiator for facilitating the transfer of thermal energy out of the first means.

4. The invention of claim 3 wherein the cooling system is a Stirling cycle refrigerator having a second chamber.

5. The invention of claim 4 wherein the second chamber is a refrigerating chamber.

6. The invention of claim 4 further including means for separating the first chamber from the second chamber.

7. A self-cooling Stirling cycle refrigerator comprising:

a conduit for transporting thermal energy from a first location to a second location, the conduit being a closed loop having first and second ends terminating in a first chamber;

a working fluid disposed in said conduit;

a heat exchanger in thermal communication with the working fluid for facilitating the transfer of thermal energy into the conduit;

means mounted in the first chamber for moving thermal energy within the conduit from the first location to the second location, the second means being a pump including a piston which reciprocates in the first chamber, first valve means for controlling the direction of a flow of fluid in the conduit into the first chamber;

second valve means for controlling the flow of the fluid in the conduit out of the first chamber;

a second chamber;

means for separating the first chamber from the second chamber; and an expander module in the second chamber, wherein the piston is a balance mass for the expander module.

8. The invention of claim 7 wherein at least one of the valves is mounted in the piston.

9. The invention of claim 8 wherein the second of the valves is mounted in a housing for the pump.

10. The invention of claim 7 further including a radiator for facilitating the transfer of thermal energy out of the first means.

11. A cooling method including the steps of:

transporting thermal energy into a working fluid in a closed loop conduit and out of the conduit with a heat exchanger in thermal communication therewith and moving the fluid within the conduit using a balancer mass of a Stirling cycle cooler.

12. The invention of claim 11 wherein said balancer mass is a piston.

13. The invention of claim 12 further including the step of controlling the direction of flow of the fluid in the conduit with a valve mounted in the piston.

* * * * *